US009587204B2

(12) United States Patent
Vockenroth et al.

(10) Patent No.: US 9,587,204 B2
(45) Date of Patent: Mar. 7, 2017

(54) DETERGENT AND CLEANING AGENT WITH POLYALKOXYLATED POLYAMINE AND ADJUSTED NON-IONIC SURFACTANT

(71) Applicant: Henkel AG & Co. KGaA, Duesseldorf (DE)

(72) Inventors: Inga Kerstin Vockenroth, Duesseldorf (DE); Nicole Bode, Duesseldorf (DE); Eva-Maria Wikker, Monheim (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/737,096

(22) Filed: Jun. 11, 2015

(65) Prior Publication Data

US 2015/0275134 A1 Oct. 1, 2015

Related U.S. Application Data

(63) Continuation of application No. PCT/EP2013/076303, filed on Dec. 12, 2013.

(30) Foreign Application Priority Data

Dec. 17, 2012 (DE) ..... 10 2012 223 336

(51) Int. Cl.

| | |
|---|---|
| ***C11D 1/02*** | (2006.01) |
| ***C11D 1/72*** | (2006.01) |
| ***C11D 1/44*** | (2006.01) |
| ***C11D 3/37*** | (2006.01) |

(52) U.S. Cl.

CPC ..... *C11D 1/44* (2013.01); *C11D 3/3769* (2013.01)

(58) Field of Classification Search

CPC ..... C11D 1/72; C11D 3/3723; C11D 3/3769; C11D 1/02

See application file for complete search history.

(56) References Cited

U.S. PATENT DOCUMENTS

| | | | | |
|---|---|---|---|---|
| 4,664,839 | A | 5/1987 | Rieck | |
| 4,820,439 | A | 4/1989 | Rieck | |
| 6,964,943 | B1 * | 11/2005 | Bettiol | C11D 1/525 510/300 |
| 7,999,035 | B2 | 8/2011 | Boeckh et al. | |
| 8,669,221 | B2 | 3/2014 | Boeckh et al. | |
| 2002/0160924 | A1 * | 10/2002 | Bertrem | C11D 1/12 510/189 |

FOREIGN PATENT DOCUMENTS

| | | | |
|---|---|---|---|
| GB | 1464427 | | 2/1977 |
| GB | 1473201 | | 5/1977 |
| GB | 1473202 | | 5/1977 |
| GB | 1473571 | | 5/1977 |
| WO | 95/32272 | A1 | 11/1995 |
| WO | 98/15608 | A2 | 4/1998 |
| WO | 2005/080538 | A1 | 9/2005 |
| WO | 2006/108857 | A1 | 10/2006 |

OTHER PUBLICATIONS

PCT International Search Report (PCT/EP2013/076303) dated Mar. 18, 2014.

* cited by examiner

*Primary Examiner* — Brian P Mruk

(74) *Attorney, Agent, or Firm* — Thomas G. Krivulka

(57) ABSTRACT

The primary washing power of detergents and cleaning agents, particularly with regard to protein-containing soiling, was to be improved. This was achieved substantially by incorporating a combination of polyalkoxylated polyamine with alkoxylated $C_8$-$C_{22}$ alcohol having an average alkoxylation degree in the range from 1 to 5.

7 Claims, No Drawings

DETERGENT AND CLEANING AGENT WITH POLYALKOXYLATED POLYAMINE AND ADJUSTED NON-IONIC SURFACTANT

FIELD OF THE INVENTION

The present invention generally relates to the use of alkoxylated polyamines in combination with low alkoxylated nonionic surfactants for improving the primary detergency of detergents or cleaning agents, in particular against protein-containing soils, during washing of textiles or cleaning of hard surfaces, and detergent and cleaning agents which contain a combination of this type.

BACKGROUND OF THE INVENTION

In addition to the ingredients that are indispensable for the washing process, such as surfactants and builder materials, detergents generally contain further components which may be combined under the term "washing aids," and which include such different active substance groups as foam regulators, anti-redeposition agents, bleaching agents, bleach activators, and dye transfer inhibitors. These types of aids also include substances whose presence enhances the detergency of surfactants, without the need in general for these substances themselves to have surfactant behavior. This similarly applies to cleaning agents for hard surfaces. Such substances are often referred to as detergency enhancers.

Alkoxylated polyamines and their use in detergents and cleaning agents are known, for example, from International Patent applications WO 95/32272 A1 and WO 2006/108857 A1. Amphiphilic water-soluble alkoxylated polyamines having an internal polyoxyethylene block and an external polyoxypropylene block are known from International Patent application WO 2006/108856 A1.

It has surprisingly been found that alkoxylated polyamines have particularly good properties which enhance the primary detergency when they are combined with certain nonionic surfactants.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Use of a combination of polyalkoxylated polyamines which are obtainable by reacting polyamines with alkylene oxide, in particular ethylene oxide and/or propylene oxide, containing alkoxylated $C_8$-$C_{18}$ alcohols having an average alkoxylation number in the range of 1 to 5, in particular 2 to 4, in detergents or cleaning agents for enhancing the primary detergency or cleaning power against soils during washing of textiles or cleaning of hard surfaces.

Use of polyalkoxylated polyamines which are obtainable by reacting polyamines with alkylene oxide, in particular ethylene oxide and/or propylene oxide, for enhancing the primary detergency or cleaning power of detergents or cleaning agents which contain alkoxylated $C_8$-$C_{18}$ alcohol having an average alkoxylation number in the range of 1 to 5, in particular 2 to 4, during washing of textiles or cleaning of hard surfaces.

Method for removing soils, in particular protein-containing soils or soils due to preparations containing protein, from textiles or hard surfaces, in which a detergent or cleaning agent and a combination of polyalkoxylated polyamines, which are obtainable by reacting polyamines with alkylene oxide, in particular ethylene oxide and/or propylene oxide, containing alkoxylated $C_8$-$C_{18}$ alcohols having an average alkoxylation number in the range of 1 to 5, in particular 2 to 4, are used.

Detergent or cleaning agent containing a combination of polyalkoxylated polyamine which is obtainable by reacting polyamines with alkylene oxide, containing alkoxylated $C_8$-$C_{18}$ alcohol having an average alkoxylation number in the range of 1 to 5, in particular in quantities of 0.3% by weight to 20% by weight.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The subject matter of the invention relates to the use of a combination of polyalkoxylated polyamines which are obtainable by reacting polyamines with alkylene oxide, in particular ethylene oxide and/or propylene oxide, containing alkoxylated $C_8$-$C_{18}$ alcohols having an average alkoxylation number in the range of 1 to 5, in particular 2 to 4, in detergents or cleaning agents for enhancing the primary detergency or cleaning power against soils during washing of textiles or cleaning of hard surfaces. The weight ratio of polyalkoxylated polyamine to alkoxylated $C_8$-$C_{18}$ alcohol having an average alkoxylation number of 1 to 5 is preferably in the range of 1:3 to 3:1, in particular 1:2 to 2:1.

A further subject matter of the invention relates to the use of polyalkoxylated polyamines which are obtainable by reacting polyamines with alkylene oxide, in particular ethylene oxide and/or propylene oxide, for enhancing the primary detergency or cleaning power of detergents or cleaning agents which contain alkoxylated $C_8$-$C_{18}$ alcohol having an average alkoxylation number in the range of 1 to 5, in particular 2 to 4, during washing of textiles or cleaning of hard surfaces.

One particular advantage of the invention is that the primary detergency-enhancing effect is particularly pronounced when the aim is remove protein-containing soils.

One embodiment of the invention, therefore, is the appropriate use for removing protein-containing soils, for example blood, egg, or milk, or soils due to preparations containing protein, for example chocolate, coffee with milk, and pudding.

A further subject matter of the invention relates to a method for removing soils, in particular protein-containing soils or soils due to preparations containing protein, from textiles or hard surfaces, in which a detergent or cleaning agent and a stated combination of polyalkoxylated polyamine and low alkoxylated alcohol are used. This method may be carried out by hand or by machine, using a household washing machine or dishwasher, for example. It is possible for agents, in particular liquid agents, and the active substance combination to be used at the same time or one after the other. The simultaneous use may be carried out particularly advantageously by employing an agent which contains the active substance combination. The concentration of the stated polyalkoxylated polyamine in the detergent or cleaning solution, which in particular is aqueous, is preferably 1 mg/L to 500 mg/L, in particular 5 mg/L to 200 mg/L; the concentration of the stated low alkoxylated alcohol in the detergent or cleaning solution, which in particular is aqueous, is 1 mg/L to 500 mg/L, in particular 5 mg/L to 200 mg/L.

Within the scope of the present invention and its individual aspects, the polyalkoxylated polyamine is a polymer having a backbone containing an N atom, the backbone bearing polyalkoxy groups on the N atoms. The polyamine has primary amino functions at the ends, and in the interior preferably has secondary and tertiary amino functions; the polyamine may optionally have only secondary amino functions in the interior, resulting in a linear, not a branched-chain, polyamine. The ratio of primary to secondary amino groups in the polyamine is preferably in the range of 1:0.5 to 1:1.5, in particular in the range of 1:0.7 to 1:1. The ratio of primary to tertiary amino groups in the polyamine is preferably in the range of 1:0.2 to 1:1, in particular in the range of 1:0.5 to 1:0.8. The polyamine preferably has an average molar mass in the range of 500 g/mol to 50,000 g/mol, in particular 550 g/mol to 5000 g/mol. The average molar masses for other polymeric ingredients stated here and possibly subsequently are weight average molar masses $M_W$, which in principle are determinable by gel permeation chromatography, using an RI detector, the measurement advantageously being performed against an external standard. The N atoms in the polyamine are preferably separated by alkylene, alkenylene, arylene, and/or alkylarylene groups, preferably by alkylene groups, containing 2 to 12 C atoms, in particular 2 to 6 C atoms, wherein not all alkylene groups have to have the same number of C atoms. Ethylene groups, 1,2-propylene groups, 1,3-propylene groups, and mixtures thereof are particularly preferred. The primary amino functions in the polyamine may bear one or two polyalkoxy groups, and the secondary amino functions may bear one polyalkoxy group, wherein not every amino function has to be substituted with alkoxy groups. The average number of alkoxy groups for each primary and secondary amino function in the polyalkoxylated polyamine is preferably 1 to 100, in particular 5 to 70. The alkoxy groups in the polyalkoxylated polyamine are alkoxy groups, preferably propoxy and/or ethoxy groups, which are directly bound to N atoms, and optionally alkoxy groups, preferably propoxy and/or ethoxy groups, which are bound to alkoxy radicals. The polyalkoxylated polyamines are obtainable by reacting polyamines with alkylene oxide, preferably propylene oxide and/or ethylene oxide, wherein a plurality of alkylene oxides, preferably propylene oxide and ethylene oxide, may be used together, or first one and then the other is used, preferably using propylene oxide first, followed by ethylene oxide, or using ethylene oxide first, followed by propylene oxide. The terminal OH function of at least some of the polyalkoxy substituents may be replaced, if desired, by an alkyl ether function having 1 to 10, in particular 1 to 3, C atoms.

Within the scope of the present invention and its individual aspects, alkoxylated $C_8$-$C_{18}$ alcohols are obtainable by reacting appropriate alcohols with alkylene oxide, wherein primary linear or branched-chain alcohols are preferred. Accordingly, the alkoxylates of primary alcohols having linear, in particular decyl, dodecyl, tridecyl, tetradecyl, hexadecyl, or octadecyl, radicals and mixtures thereof are usable. In preferred embodiments of the invention, the alcohol has 16 C atoms maximum, in particular 12 to 14 C atoms. The alkoxylation number, i.e., the average number of alkoxy groups per alcohol function, of the low alkoxylated alcohol may assume integer or fractional numerical values, and is preferably in the range of 2 to 4, in particular 2 to 3.5. Preferred alkoxy groups are ethoxy, propoxy, and butoxy groups, in particular ethoxy groups and mixtures of ethoxy and propoxy groups.

The stated combination of polyalkoxylated polyamine and alkoxylated alcohol is preferably used according to the invention in detergents or cleaning agents in a quantity of 0.1% by weight to 10% by weight, in particular in a quantity of 0.2% by weight to 2% by weight, of the polyalkoxylated polyamine, and in a quantity of 0.2% by weight to 10% by weight, in particular in a quantity of 0.5% by weight to 5% by weight, of the stated alkoxylated alcohol, wherein here and subsequently, unless stated otherwise, the term "% by weight" in each case refers to the weight of the overall detergent or cleaning agent. A further subject matter of the invention therefore relates to a detergent or cleaning agent containing a combination of polyalkoxylated polyamine, which is obtainable by reacting polyamines with alkylene oxide, with alkoxylated $C_8$-$C_{18}$ alcohol having an average alkoxylation number in the range of 1 to 5.

Detergents or cleaning agents which contain the active substances to be used in combination according to the invention or which are used together with same or used in the method according to the invention may contain all other customary components of such agents which do not interact adversely with the active substance according to the invention. The detergent or cleaning agent preferably contains an active substance combination as defined above in quantities of 0.3% by weight to 20% by weight, in particular 0.7% by weight to 6.5% by weight.

It has surprisingly been found that these types of active substances positively influence the effect of certain other detergent and cleaning agent ingredients, and that conversely, the effect of the active substance combination is even further intensified by certain other ingredients. These effects appear in particular in synthetic anionic surfactants of the sulfate and sulfonate type, for which reason the use of at least these ingredients, and optionally one or more of the named further ingredients, together with the active substance to be used according to the invention is preferred.

An agent which contains an active substance combination to be used according to the invention or which is used together with same or used in the method according to the invention preferably contains synthetic anionic surfactants of the sulfate and sulfonate type in quantities of preferably not greater than 20% by weight, in particular 0.1% by weight to 18% by weight, in each case based on the overall agent. Synthetic anionic surfactants which are particularly suitable for use in these types of agents include alkyl and/or alkenyl sulfates containing 8 to 22 C atoms which bear an alkali-, ammonium-, or alkyl- or hydroxyalkyl-substituted ammonium ion as countercation. The derivatives of the fatty alcohols containing in particular 12 to 18 C atoms and their branched-chain analogs, the so-called oxo alcohols, are preferred. The alkyl and alkenyl sulfates may be prepared in a known manner by reacting the corresponding alcohol component with a customary sulfating reagent, in particular sulfur trioxide or chlorosulfonic acid, and subsequent neutralization with alkali-, ammonium-, or alkyl- or hydroxyalkyl-substituted ammonium bases. Surfactants of the sulfate type which are particularly preferably usable include the above-mentioned sulfated alkoxylation products of the named alcohols, so-called ether sulfates. Such ether sulfates preferably contain 2 to 30, in particular 4 to 10, ethylene glycol groups per molecule. Suitable anionic surfactants of the sulfonate type include α-sulfo esters which are obtainable by reaction of fatty acid esters with sulfur trioxide and subsequent neutralization, in particular the sulfonation products derived from fatty acids containing 8 to 22 C atoms, preferably 12 to 18 C atoms, and linear alcohols containing 1 to 6 C atoms, preferably 1 to 4 C atoms, and the sulfo fatty acids which result from same by formal saponification. Usable anionic surfactants also include the salts of sulfosuccinic acid esters, also referred to as alkylsulfosuccinates or dialkylsulfosuccinates, and the monoesters or diesters of sulfosuccinic acid with alcohols, preferably fatty alcohols and in particular ethoxylated fatty alcohols. Preferred sulfosuccinates contain $C_8$ to $C_{18}$ fatty alcohol radicals or mixtures thereof. Particularly preferred sulfosuccinates contain an ethoxylated fatty alcohol radical, which in itself represents a nonionic surfactant. Sulfosuccinates whose fatty alcohol radicals are derived from ethoxylated fatty alcohols with a narrow homolog distribution are once again particularly preferred. Alkylbenzene sulfonate is another suitable synthetic anionic surfactant.

A further embodiment of the agents includes the presence of further nonionic surfactant, selected from fatty alkyl polyglycosides, fatty alkyl polyalkoxylates which are different from the above-mentioned alkoxylated $C_8$-$C_{22}$ alcohol, essential to the invention, having an average alkoxylation number in the range of 1 to 5, fatty acid polyhydroxyamides, and/or ethoxylation and/or propoxylation products of fatty alkylamines, vicinal diols, fatty acid alkyl esters, and/or fatty acid amides and mixtures thereof, in particular in a quantity in the range of 2% by weight to 25% by weight.

Suitable nonionic surfactants include the alkoxylates, in particular the ethoxylates and/or propoxylates, of saturated or singly to multiply unsaturated linear or branched-chain alcohols containing 10 to 22 C atoms, preferably 12 to 18 C atoms, in which the alkoxylation number of the alcohols is below 20, preferably below 10. The alkoxylates may be produced in a known manner by reacting the corresponding alcohols with the appropriate alkylene oxides. The derivatives of the fatty alcohols are particularly suitable, although their branched-chain isomers, in particular so-called oxo alcohols, may also be used for producing usable alkoxylates. Accordingly, the alkoxylates, in particular the ethoxylates, of primary alcohols having linear, in particular dodecyl, tetradecyl, hexadecyl, or octadecyl, radicals and mixtures thereof are usable. Appropriate alkoxylation products of alkylamines, vicinal diols, and carboxylic acid amides which correspond to the named alcohols with regard to the alkyl portion are also usable. Furthermore, the ethylene oxide and/or propylene oxide insertion products of fatty acid alkyl esters, and also fatty acid polyhydroxyamides are suitable. So-called alkyl polyglycosides which are suitable for incorporation into the agents according to the invention are compounds of the general formula $(G)_n$-$OR^{12}$, in which $R^{12}$ means an alkyl or alkenyl radical containing 8 to 22 C atoms, G means a glycose unit, and n means a number between 1 and 10. The glycoside component $(G)_n$ is oligomers or polymers of naturally occurring aldose or ketose monomers, which include in particular glucose, mannose, fructose, galactose, talose, gulose, altrose, allose, idose, ribose, arabinose, xylose, and lyxose. The oligomers made up of such glycosidically linked monomers are characterized not only by the type but also by the number of sugars which they contain, the so-called degree of oligomerization. The degree of oligomerization n generally assumes fractional numbers as values to be analytically determined, and has values between 1 and 10, and for the preferably used glycosides, has a value less than 1.5, in particular between 1.2 and 1.4. Glucose is a preferred monomer structural unit since it is readily available. The alkyl or alkenyl portion $R^{12}$ of the glycosides preferably likewise comes from readily available derivatives of renewable raw materials, in particular fatty alcohols, although their branched-chain isomers, in particular so-called oxo alcohols, may also be used for producing usable glycosides. In particular the primary alcohols having linear octyl, decyl, dodecyl, tetradecyl, hexadecyl, or octadecyl radicals and mixtures thereof are therefore usable. Particularly preferred alkyl glycosides contain a coconut fatty alkyl radical, i.e., mixtures of essentially $R^{12}$=dodecyl and $R^{12}$=tetradecyl.

In agents which contain an active substance combination that is used according to the invention or is employed within the scope of the use according to the invention, including the quantity of low alkoxylated $C_8$-$C_{18}$ alcohol from the active substance combination which is essential to the invention, nonionic surfactant is preferably contained in quantities of 1% by weight to 30% by weight, in particular 1% by weight to 25% by weight, wherein quantities in the upper part of this range are more preferably found in liquid detergents, and particle-form detergents more preferably contain smaller quantities of up to 5% by weight.

Soaps are further optional surfactant ingredients that are suitable, wherein saturated fatty acid soaps such as the salts of lauric acid, myristic acid, palmitic acid, or stearic acid, and soaps derived from natural fatty acid mixtures, for example coconut, palm kernel, or tallow fat acids, are suitable. Particularly preferred are soap mixtures composed of 50% by weight to 100% by weight of saturated $C_{12}$-$C_{18}$ fatty acid soaps and up to 50% by weight of oleic acid soap. Soap is preferably contained in quantities of 0.1% by weight to 5% by weight. However, even higher soap quantities of generally up to 20% by weight may be contained, in particular in liquid agents which contain an active substance combination used according to the invention.

The agents may also contain betaines and/or cationic surfactants, if desired, which—if present—are preferably used in quantities of 0.5% by weight to 7% by weight. Among these, esterquats are particularly preferred.

The agents may contain peroxygen-based bleaching agents if desired, in particular in quantities in the range of 5% by weight to 70% by weight, and optionally bleach activator, in particular in quantities in the range of 2% by weight to 10% by weight. Suitable bleaching agents are preferably the peroxygen compounds generally used in detergents, for example percarboxylic acids such as perdodecanoic acid or phthaloylamino peroxycaproic acid, and hydrogen peroxide, alkali perborate, which may be present as the tetra- or monohydrate, percarbonate, and perpyrophosphate and persilicate, which are generally present as alkali salts, in particular as sodium salts. In detergents which contain an active substance combination used according to the invention, these types of bleaching agents are preferably present in quantities of up to 25% by weight, in particular up to 15% by weight, and particularly preferably 5% by weight to 15% by weight, in each case based on the overall agent, in particular percarbonate being used. The optionally present component of the bleach activators includes the customarily used N- or O-acyl compounds, for example multiply acylated alkylenediamines, in particular tetraacetylethylenediamine, acylated glycolurils, in particular tetraacetylglycoluril, N-acylated hydantoins, hydrazides, triazoles, urazoles, diketopiperazines, sulfuryl amides, and cyanurates, in addition to carboxylic acid anhydrides, in particular phthalic anhydride, carboxylic acid esters, in particular sodium isononanoyl phenol sulfonate, and acylated sugar derivatives, in particular pentaacetyl glucose, as well as cationic nitrile derivatives such as trimethylammonium acetonitrile salts. To avoid interaction with the peroxygen compounds during storage, the bleach activators may have been coated with casing substances and/or granulated in a known manner, wherein tetraacetylethylenediamine, granulated with the aid of carboxymethylcellulose and having average grain sizes of 0.01 mm to 0.8 mm, granulated 1,5-diacetyl-2,4-dioxohexahydro-1,3,5-triazine, and/or trialkylammonium acetonitrile prepared in particle form are particularly preferred. These types of bleach activators are preferably contained in detergents in quantities of up to 8% by weight, in particular 2% by weight to 6% by weight, in each case based on the overall agent.

In a further embodiment, the agent contains water-soluble and/or water-insoluble builders, in particular selected from alkali aluminosilicate, crystalline alkali silicate having a modulus greater than 1, monomeric polycarboxylate, and polymeric polycarboxylate and mixtures thereof, in particular in quantities in the range of 2.5% by weight to 60% by weight.

The agent preferably contains 20% by weight to 55% by weight of water-soluble and/or water-insoluble, organic and/or inorganic builders. The water-soluble organic builder substances include in particular those from the class of polycarboxylic acids, in particular citric acid and sugar acids, and the polymeric (poly-)carboxylic acids, in particular the polycarboxylates obtainable by oxidation of polysaccharides, and polymeric acrylic acids, methacrylic acids, maleic acids, and mixed polymers thereof, which may also contain small quantities of polymerizable substances without carboxylic acid functionality which are polymerized in. The relative molecular mass of the homopolymers of unsaturated carboxylic acids is generally between 5000 g/mol and 200,000 g/mol, and the relative molecular mass of the copolymers is generally between 2000 g/mol and 200,000 g/mol, preferably 50,000 g/mol to 120,000 g/mol, based on the free acid. A particularly preferred acrylic acid-maleic acid copolymer has a relative molecular mass of 50,000 g/mol to 100,000 g/mol. Suitable compounds of this class, although less preferred, are copolymers of acrylic acid or methacrylic acid with vinyl ethers such as vinyl methyl ether, and vinyl esters, ethylene, propylene, and styrene, in which the acid content is at least 50% by weight. Terpolymers containing two carboxylic acids and/or salts thereof as monomers, and containing vinyl alcohol and/or a vinyl alcohol derivative or a carbohydrate as third monomer, may also be used as water-soluble organic builder substances. The first acid monomer or salt thereof is derived from a monoethylenically unsaturated $C_3$-$C_8$ carboxylic acid, and preferably from a $C_3$-$C_4$ monocarboxylic acid, in particular from (meth-)acrylic acid. The second acid monomer or salt thereof may be a derivative of a $C_4$-$C_8$ dicarboxylic acid, maleic acid being particularly preferred. The third monomer unit in this case is formed by vinyl alcohol and/or preferably an esterified vinyl alcohol. In particular, vinyl alcohol derivatives which represent an ester of short-chain carboxylic acids, for example $C_1$-$C_4$ carboxylic acids, with vinyl alcohol are preferred. Preferred terpolymers contain 60% by weight to 95% by weight, in particular 70% by weight to 90% by weight, of (meth)acrylic acid and/or (meth)acrylate, particularly preferably acrylic acid and/or acrylate, and maleic acid and/or maleate, and 5% by weight to 40% by weight, preferably 10% by weight to 30% by weight, of vinyl alcohol and/or vinyl acetate. Terpolymers in which the weight ratio of (meth)acrylic acid and/or (meth)acrylate to maleic acid and/or maleate is between 1:1 and 4:1, preferably between 2:1 and 3:1, and in particular between 2:1 and 2.5:1, are very particularly preferred. In this regard, the quantities as well as the weight ratios are based on the acids. The second acid monomer or salt thereof may also be a derivative of an allylsulfonic acid that is substituted in the 2-position with an alkyl radical, preferably a $C_1$-$C_4$ alkyl radical, or an aromatic radical which is preferably derived from benzene or benzene derivatives. Preferred terpolymers contain 40% by weight to 60% by weight, in particular 45% by weight to 55% by weight, of (meth)acrylic acid and/or (meth)acrylate, particularly preferably acrylic acid and/or acrylate, 10% by weight to 30% by weight, preferably 15% by weight to 25% by weight, of methallylsulfonic acid and/or methallyl sulfonate, and 15% by weight to 40% by weight, preferably 20% by weight to 40% by weight, of a carbohydrate as third monomer. This carbohydrate may be a mono-, di-, oligo-, or polysaccharide, for example, with mono-, di-, or oligosaccharides being preferred and sucrose being particularly preferred. Due to the use of the third monomer, predetermined breaking points which are responsible for the good biodegradability of the polymer are presumably incorporated into the polymer. These terpolymers generally have a relative molecular mass between 1000 g/mol and 200,000 g/mol, preferably between 2000 g/mol and 50,000 g/mol, and in particular between 3000 g/mol and 10,000 g/mol. The terpolymers may be used in particular for producing liquid agents in the form of aqueous solutions, preferably in the form of 30 to 50% by weight aqueous solutions. All of the named polycarboxylic acids are generally used in the form of their water-soluble salts, in particular their alkali salts.

These types of organic builder substances are preferably contained in quantities of up to 40% by weight, in particular up to 25% by weight, and particularly preferably 1% by weight to 5% by weight. Quantities close to the stated upper limit are preferably used in agents in paste or liquid form, in particular in agents containing water.

As water-insoluble, water-dispersible inorganic builder materials, in particular crystalline or amorphous alkali aluminosilicates are used in quantities of up to 50% by weight, preferably not greater than 40% by weight, and in liquid agents are used in particular in quantities of 1% by weight to 5% by weight. Among these, the crystalline aluminosilicates in detergent quality, in particular zeolite NaA and optionally NaX, are preferred. Quantities close to the stated upper limit are preferably used in solid particle-form agents. Suitable aluminosilicates in particular have no particles with a grain size greater than 30 μm, and are preferably composed of at least 80% by weight of particles having a size less than 10 μm. The calcium binding capacity of the aluminosilicates, which may be determined according to the information in German Patent DE 24 12 837, are in the range of 100 to 200 mg CaO per gram. Suitable substitutes or partial substitutes for the named aluminosilicate are crystalline alkali silicates, which may be present alone or in a mixture with amorphous silicates. The alkali silicates which are usable in the agents as builders preferably have a molar ratio of alkali oxide to $SiO_2$ of less than 0.95, in particular 1:1.1 to 1:12, and may be present in amorphous or crystalline form. Preferred alkali silicates are sodium silicates, in particular amorphous sodium silicates, having a $Na_2O:SiO_2$ molar ratio of 1:2 to 1:2.8. Such amorphous alkali silicates are commercially available under the name Portil®, for example. Within the scope of the production, amorphous alkali silicates having a $Na_2O:SiO_2$ molar ratio of 1:1.9 to 1:2.8 are preferably added as a solid, and not in the form of a solution. Crystalline layered silicates of the general formula $Na_2Si_xO_{2x+1}.y\ H_2O$, in which x, the so-called modulus, is a number from 1.9 to 4 and y is a number from 0 to 20, and preferred values of x are 2, 3, or 4, are preferably used as crystalline silicates, which may be present alone or in a mixture with amorphous silicates. Crystalline layered silicates which are included in this general formula are described in European Patent application EP 0 164 514, for example. Preferred crystalline layered silicates are those in which in the stated general formula x assumes the values 2 or 3. In particular, β- as well as δ-sodium disilicates ($Na_2Si_2O_5.y\ H_2O$) are preferred. Crystalline alkali silicates of the above-mentioned general formula, in which x means a number from 1.9 to 2.1, which are produced from amorphous alkali silicates and are practically water-free may also be used in agents which contain an active substance combination to be used according to the invention. In another preferred embodiment of agents according to the invention, a crystalline sodium layered silicate having a modulus of 2 to 3 is used, which may be produced from sand and soda. Crystalline sodium silicates having a modulus in the range of 1.9 to 3.5 are used in another preferred embodiment of detergents which contain an active substance combination that is used according to the invention. Their content of alkali silicates is preferably 1% by weight to 50% by weight, and in particular 5% by weight to 35% by weight, based on water-free active substance. If alkali aluminosilicate, in particular zeolite, is present as additional builder substance, the content of alkali silicate is preferably 1% by weight to 15% by weight, and in particular 2% by weight to 8% by weight, based on water-free active substance. The weight ratio of aluminosilicate to silicate, in each case based on water-free active substances, is then preferably 4:1 to 10:1. In agents which contain amorphous as well as crystalline alkali silicates, the weight ratio of amorphous alkali silicate to crystalline alkali silicate is preferably 1:2 to 2:1, and in particular 1:1 to 2:1.

In addition to the named inorganic builder, further water-soluble or water-insoluble inorganic substances may be contained in the agents which contain an active substance that is to be used according to the invention, or which are used together with same or used in the method according to the invention. In this regard, alkali carbonates, alkali hydrogen carbonates, and alkali sulfates and mixtures thereof are suitable. Such additional inorganic material may be present in quantities of up to 70% by weight.

In one preferred embodiment of the invention, an agent according to the invention contains a water-soluble builder block. Use of the term "builder block" is intended to mean that the agents contain no further builder substances than those which are water-soluble; i.e., all builder substances contained in the agent are combined in the "block" thus characterized, in any event excluding the quantities of substances which as impurities or stabilizing additives may customarily be contained in small amounts in the usual ingredients of the agents. The term "water-soluble" is understood to mean that the builder block dissolves free of residue at the concentration which results from the used quantity of agent containing the builder block under customary conditions. Preferably at least 15% by weight and up to 55% by weight, in particular 25% by weight to 50% by weight, of water-soluble builder block is contained in the agents according to the invention. The builder block is preferably composed of the following components:

a) 5% by weight to 35% by weight of citric acid, alkali citrate, and/or alkali carbonate, which may also be replaced, at least partially, by alkali hydrogen carbonate, b) up to 10% by weight of alkali silicate having a modulus in the range of 1.8 to 2.5, c) up to 2% by weight of phosphonic acid and/or alkali phosphonate, d) up to 50% by weight of alkali phosphate, and e) up to 10% by weight of polymeric polycarboxylate, wherein the statements concerning quantities are based on the overall detergent or cleaning agent.

In one preferred embodiment of agents according to the invention, the water-soluble builder block contains at least two of components b), c), d), and e) in quantities greater than 0% by weight.

With regard to component a), in one preferred embodiment of agents according to the invention, 15% by weight to 25% by weight of alkali carbonate, which may be replaced, at least partially, by alkali hydrogen carbonate, and up to 5% by weight, in particular 0.5% by weight to 2.5% by weight, of citric acid and/or alkali citrate are contained. In an alternative embodiment of agents according to the invention, 5% by weight to 25% by weight, in particular 5% by weight to 15% by weight, of citric acid and/or alkali citrate and up to 5% by weight, in particular 1% by weight to 5% by weight, of alkali carbonate, which may be replaced, at least partially, by alkali hydrogen carbonate, are contained as component a). If alkali carbonate and alkali hydrogen carbonate are both present, component a) preferably contains alkali carbonate and alkali hydrogen carbonate in a weight ratio of 10:1 to 1:1.

With regard to component b), in one preferred embodiment of agents according to the invention, 1% by weight to 5% by weight of alkali silicate having a modulus in the range of 1.8 to 2.5 is contained.

With regard to component c), in one preferred embodiment of agents according to the invention, 0.05% by weight to 1% by weight of phosphonic acid and/or alkali phosphonate is contained. Phosphonic acids are also understood to mean optionally substituted alkylphosphonic acids which may also contain multiple phosphonic acid groups (so-called polyphosphonic acids). Such acids are preferably selected from hydroxy- and/or aminoalkylphosphonic acids and/or the alkali salts thereof, such as dimethylaminomethane diphosphonic acid, 3-aminopropane-1-hydroxy-1,1-diphosphonic acid, 1-amino-1-phenylmethane diphosphonic acid, 1-hydroxyethane-1,1-diphosphonic acid, amino-tris(methylenephosphonic acid), N,N,N',N'-ethylenediamine-tetrakis (methylenephosphonic acid), and acylated derivatives of phosphorous acid, which may also be used in any desired mixtures.

With regard to component d), in one preferred embodiment of agents according to the invention, 15% by weight to 35% by weight of alkali phosphate, in particular trisodium polyphosphate, is contained.

With regard to component e), in one preferred embodiment of agents according to the invention, 1.5% by weight to 5% by weight of polymeric polycarboxylate, in particular selected from the polymerization or copolymerization products of acrylic acid, methacrylic acid, and/or maleic acid, are contained. Among these, the homopolymers of acrylic acid, and of these, in turn those having an average molar mass in the range of 5000 g/mol to 15,000 g/mol (PA standard), are particularly preferred.

In addition, the agents may contain further components which are customary in detergents or cleaning agents. These optional components include in particular enzymes, enzyme stabilizers, complexing agents for heavy metals, for example aminopolycarboxylic acids, aminohydroxypolycarboxylic acids, polyphosphonic acids, and/or aminopolyphosphonic acids, and foam inhibitors, for example organopolysiloxanes or paraffins, and solvents and optical brighteners, for example stilbene disulfonic acid derivatives. Agents which contain an active substance combination used according to the invention preferably contain up to 1% by weight, in particular 0.01% by weight to 0.5% by weight, of optical brighteners, in particular compounds from the class of substituted 4,4'-bis-(2,4,6-triamino-s-triazinyl)stilbene-2,2'-disulfonic acids, up to 5% by weight, in particular 0.1% by weight to 2% by weight, of complexing agents for heavy metals, in particular aminoalkylene phosphonic acids and salts thereof, and up to 2% by weight, in particular 0.1% by weight to 1% by weight, of foam inhibitors, wherein the stated weight proportions in each case are based on the overall agent.

In addition to water, solvents which may be used in particular in liquid agents preferably include nonaqueous solvents that are miscible with water. These include the lower alcohols, for example ethanol, propanol, isopropanol, and the isomeric butanols, and glycerin, lower glycols, for example ethylene glycol and propylene glycol, and the ethers which are derivable from the named compound classes. The active substances used according to the invention are generally present in such liquid agents in dissolved or suspended form.

Optionally present enzymes are preferably selected from the group comprising protease, amylase, lipase, cellulase, hemicellulase, oxidase, peroxidase, pectinase, and mixtures thereof. Protease obtained from microorganisms such as bacteria or fungi are primarily suitable. Protease may be obtained from suitable microorganisms in a known manner via fermentation processes. Proteases are commercially available under the names BLAP®, Savinase®, Esperase®, Maxatase®, Optimase®, Alcalase®, Durazym®, or Maxapem®, for example. Usable lipase may be obtained, for example, from *Humicola lanuginosa*, from *Bacillus* species, from *Pseudomonas* species, from *Fusarium* species, from *Rhizopus* species, or from *Aspergillus* species. Suitable lipases are commercially available under the names Lipolase®, Lipozym®, Lipomax®, Lipex®, Amano® lipase, Toyo Jozo® lipase, Meito® lipase, and Diosynth® lipase. Suitable amylases are commercially available under the names Maxamyl®, Termamyl®, Duramyl®, and Purafect® OxAm, for example. Usable cellulase may be an enzyme, obtainable from bacteria or fungi, which has a pH optimum preferably in the weakly acidic to weakly alkaline range of 6 to 9.5. These types of cellulases are commercially available under the names Celluzyme®, Carezyme®, and Ecostone®. Suitable pectinases are obtainable, for example, under the names Gamanase®, Pectinex AR®, X-Pect®, or Pectaway® from Novozymes, under the names Rohapect UF®, Rohapect TPL®, Rohapect PTE100®, Rohapect MPE®, Rohapect MA plus HC, Rohapect DA12L®, Rohapect 10L®, Rohapect B1L® from AB Enzymes, and under the names Pyrolase® from Diverse Corp., San Diego, Calif., US.

Customary enzyme stabilizers which are optionally present, in particular in liquid agents, include amino alcohols, for example mono-, di-, and triethanolamine and mono-, di-, and tripropanolamine and mixtures thereof, lower carboxylic acids, boric acid, alkali borates, boric acid-carboxylic acid combinations, boric acid esters, boric acid derivatives, calcium salts, for example a combination of Ca and formic acid, magnesium salts, and/or sulfur-containing reducing agents.

Suitable foam inhibitors include long-chain soaps, in particular behenic soap, fatty acid amides, paraffins, waxes, microcrystalline waxes, and organopolysiloxanes and mixtures thereof, which may also contain microfine, optionally silanated or otherwise hydrophobized silicic acid. For use in particle-form agents, foam inhibitors of this type are preferably bound to granular, water-soluble carrier substances.

The known polyester-active dirt-loosening polymers, which may be used in addition to the active substance combinations that are essential to the invention, include copolyesters from dicarboxylic acids, for example adipic acid, phthalic acid, or terephthalic acid, and diols, for example ethylene glycol or propylene glycol, and polydiols, for example polyethylene glycol or polypropylene glycol. The preferably used dirt-loosening polyesters include compounds which are available by formal esterification of two monomer portions, the first monomer being a dicarboxylic acid HOOC-Ph-COOH, and the second monomer being a diol H—(O—(CHR$^{11}$—)$_a$OH which may also be present as a polymeric diol HO—(CHR$^{11}$—)$_a$)$_b$OH. In the formulas, Ph means an o-, m-, or p-phenylene radical which may bear 1 to 4 substituents selected from alkyl radicals containing 1 to 22 C atoms, sulfonic acid groups, carboxyl groups, and mixtures thereof, R$^{11}$ means hydrogen, an alkyl radical containing 1 to 22 C atoms, and mixtures thereof, a means a number from 2 to 6, and b means a number from 1 to 300. The polyesters which are obtainable therefrom preferably contain monomer diol units —O—(CHR$^{11}$—)$_a$O— as well as polymer diol units —O—(CHR$^{11}$—)$_a$)$_b$O—. The molar ratio of monomer diol units to polymer diol units is preferably 100:1 to 1:100, in particular 10:1 to 1:10. The degree of polymerization b in the polymer diol units is preferably in the range of 4 to 200, in particular 12 to 140. The molecular weight or the average molecular weight or the maximum of the molecular weight distribution of preferred dirt-loosening polyesters is in the range of 250 g/mol to 100,000 g/mol, in particular 500 g/mol to 50,000 g/mol. The acid on which the Ph radical is based is preferably selected from terephthalic acid, isophthalic acid, phthalic acid, trimellitic acid, mellitic acid, the isomers of sulfophthalic acid, sulfoisophthalic acid, and sulfoterephthalic acid, and mixtures thereof. If the acid groups of the named compounds are not part of the ester bonds in the polymer, they are preferably present in the form of a salt, in particular an alkali or ammonium salt. Of these, the sodium and potassium salts are particularly preferred. If desired, instead of the HOOC-Ph-COOH monomer, small quantities, in particular not more than 10 mol-%, based on the content of Ph having the meaning stated above, of other acids which have at least two carboxyl groups may be contained in the dirt-loosening polyester. These acids include, for example, alkylene and alkenylene dicarboxylic acids such as malonic acid, succinic acid, fumaric acid, maleic acid, glutaric acid, adipic acid, pimelic acid, suberic acid, azelaic acid, and sebacic acid. The preferred diols HO—(CHR$^{11}$—)$_a$OH include those in which R$^{11}$ is hydrogen and a is a number from 2 to 6, and those in which a has the value 2 and R$^{11}$ is selected from among hydrogen and the alkyl radicals containing 1 to 10, in particular 1 to 3, C atoms. Of the latter-referenced diols, those of formula HO—CH$_2$—CHR$^{11}$—OH, in which R$^{11}$ has the meaning stated above, are particularly preferred. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol, and neopentyl glycol. Among the polymeric diols, polyethylene glycol, having an average molar mass in the range of 1000 g/mol to 6000 g/mol, is particularly preferred. If desired, the polyesters may also be closed by end groups, wherein alkyl groups containing 1 to 22 C atoms and esters of monocarboxylic acids are suitable end groups. The end groups which are bound via ester bonds may be based on alkyl, alkenyl, and arylmonocarboxylic acids containing 5 to 32 C atoms, in particular 5 to 18 C atoms. These acids include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachic acid, gadoleic acid, arachidonic acid, behenic acid, erucic acid, brassidinic acid, clupanodonic acid, lignoceric acid, cerotic acid, melissic acid, and benzoic acid, which may bear 1 to 5 substituents with a total of up to 25 C atoms, in particular 1 to 12 C atoms, for example tert-butylbenzoic acid. The end groups may also be based on hydroxymonocarboxylic acids containing 5 to 22 C atoms, which include hydroxyvaleric acid, hydroxycaproic acid, ricinoleic acid and its hydrogenation product hydroxystearic acid, and o-, m-, and p-hydroxybenzoic acid. The hydroxymonocarboxylic acids themselves may be bound to one another via their hydroxyl group and their carboxyl group, and may therefore be multiply present in an end group. The number of hydroxymonocarboxylic acid units per end group, i.e., the degree of oligomerization of hydroxymonocarboxylic acid, is preferably in the range of 1 to 50, in particular 1 to 10. In one preferred embodiment of the invention, polymers of ethylene terephthalate and polyethylene oxide terephthalate, in which the polyethylene glycol units have molar weights of 750 g/mol to 5000 g/mol, and the molar ratio of ethylene terephthalate to polyethylene oxide terephthalate is 50:50 to 90:10, may be used in combination with an active substance combination that is essential to the invention. The dirt-loosening polymers are preferably water-soluble, wherein the term "water-soluble" is understood to mean a solubility of at least 0.01 g, preferably at least 0.1 g, of the polymer per liter water at room temperature and pH 8. However, under these conditions, polymers which are preferably used have a solubility of at least 1 g per liter, in particular at least 10 g per liter.

The production of solid agents according to the invention poses no difficulties, and may be carried out in a known manner, for example by spray drying or granulation; enzymes and other possibly thermally sensitive ingredients, such as bleaching agents, may optionally be added separately at a later time. For producing agents according to the invention having an increased bulk density in particular in the range of 650 g/L to 950 g/L, a method having an extrusion step is preferred.

For producing agents according to the invention in tablet form, which may be monophasic or polyphasic, one-colored or multi-colored, and which may consist of one layer or multiple layers, in particular two layers, the preferred procedure is to mix all components, optionally for one layer each, in a mixer, and to press the mixture using conventional tablet presses, for example eccentric presses or rotary presses, with pressing forces in the range of approximately 50 to 100 kN, preferably 60 to 70 kN. In particular for multi-layer tablets it may be advantageous when at least one layer is prepressed. This is preferably carried out at pressing forces between 5 and 20 kN, in particular 10 to 15 kN. Tablets are thus easily obtained which are resistant to breakage but still sufficiently quick-dissolving under the usage conditions, with breaking strengths and bending strengths of normally 100 to 200 N, but preferably above 150 N. A tablet produced in this way preferably has a weight of 10 g to 50 g, in particular 15 g to 40 g. The rough shape of the tablets is arbitrary, and may be round, oval, or polygonal, whereby intermediate shapes are also possible. Corners and edges are advantageously rounded. Round tablets preferably have a diameter of 30 mm to 40 mm. In particular the size of polygonal or square tablets, which are introduced mainly via the dosing device of the dishwasher, for example, is dependent on the geometry and the volume of this dosing device. Examples of preferred embodiments have a base area of (20 to 30 mm)×(34 to 40 mm), in particular 26×36 mm or 24×38 mm.

Liquid or paste-like agents according to the invention in the form of solutions containing customary solvents, in particular water, are generally produced by simple mixing of the ingredients, which may be added as the substance or as a solution to an automatic mixer.

In one preferred embodiment. an agent into which active substance combination to be used according to the invention is incorporated is liquid, and contains 1% by weight to 15% by weight, in particular 2% by weight to 10% by weight, of nonionic surfactant, 2% by weight to 30% by weight, in particular 5% by weight to 20% by weight, of synthetic anionic surfactant, up to 15% by weight, in particular 2% by weight to 12.5% by weight, of soap, 0.5% by weight to 5% by weight, in particular 1% by weight to 4% by weight, of organic builder, in particular polycarboxylate such as citrate, up to 1.5% by weight, in particular 0.1% by weight to 1% by weight, of complexing agent for heavy metals, such as phosphonate, and water and/or water-miscible solvent in addition to optionally contained enzyme, enzyme stabilizer, dye, and/or fragrance.

In another preferred embodiment, an agent into which active substance combination to be used according to the invention is incorporated is in particle form, and contains up to 25% by weight, in particular 5% by weight to 20% by weight, of bleaching agent, in particular alkali percarbonate, up to 15% by weight, in particular 1% by weight to 10% by weight, of bleach activator, 20% by weight to 55% by weight of inorganic builder, up to 10% by weight, in particular 2% by weight to 8% by weight, of water-soluble organic builder, 10% by weight to 25% by weight of synthetic anionic surfactant, 1% by weight to 5% by weight of nonionic surfactant, and up to 25% by weight, in particular 0.1% by weight to 25% by weight, of inorganic salts, in particular alkali carbonate and/or alkali hydrogen carbonate.

EXAMPLES

Example 1

Detergent

TABLE 1

Detergent compositions (expressed in % by weight)

| | A | B | C | D | E | F | G | H |
|---|---|---|---|---|---|---|---|---|
| C9-13 alkylbenzene sulfonate, Na salt | 9 | 10 | 6 | 6 | 5 | 15 | 15 | 9 |
| C12-18 fatty alcohol, 7 EO | 8 | 9 | 6 | 6 | 5 | 6 | 6 | 10 |
| C12-14 fatty alcohol sulfate, 2 EO | – | – | 8 | 8 | 10 | 2 | 2 | 5 |
| C12-18 fatty acid, Na salt | 4 | 3 | 3 | – | 4 | 2 | – | 7 |
| Citric acid | 2 | 3 | 3 | 3 | 2 | 2 | 2 | 3 |
| Sodium hydroxide | 3 | 3 | 2 | 2 | 3 | 3 | 3 | 4 |
| Boric acid | 1 | 1 | 1 | 1 | 1 | 1 | 1 | 1 |

TABLE 1-continued

| Detergent compositions (expressed in % by weight) | | | | | | | | |
|---|---|---|---|---|---|---|---|---|
| | A | B | C | D | E | F | G | H |
| Enzymes | + | + | + | + | + | + | + | + |
| Fragrance | 1 | 0.5 | 0.5 | 0.5 | 1 | 1 | 1 | 1 |
| Propanediol | – | – | – | – | – | 5 | 5 | – |
| Ethanol | 1.5 | 1.5 | 1.5 | 1.5 | 1.5 | 1.5 | 1.5 | 5 |
| PVA/maleic acid copolymer | 0.1 | – | 0.1 | – | – | – | – | – |
| Optical brightener | – | 0.1 | – | 0.1 | 0.2 | 0.2 | 0.2 | 0.2 |
| Opacifier | 0.2 | – | – | – | – | – | – | – |
| Phosphonic acid, Na salt | 0.5 | 0.5 | 0.5 | 0.5 | 0.5 | 0.5 | 0.5 | 0.5 |
| Polyethyleneimine 1300, 45 EO | 1 | 1 | 1 | 1 | 1 | 1 | 1 | 1 |
| C12-14 fatty alcohol, 3EO | 1 | 1 | 1 | 1 | 1 | 1 | 1 | 1 |
| Water | To make 100 | | | | | | | |

Example 2

Washing Tests

Household washing machines (Miele® W 1514) were loaded with 3.5 kg of clean accompanying laundry and with the test textiles made of cotton, which had been provided with 108 different standardized soils, including chocolate milk/carbon black soil, and soil ballast. 66 mL of detergent C stated in Example 1 was dosed, and washing was carried out at 40° C. After the test textiles were hung to dry and mangled, their whiteness was determined by spectrophotometry (Minolta® CR400). Table 2 below shows the sums of the whiteness (Y values) over all 108 soils for agent C, for a detergent (V1) having an otherwise identical composition, but without the active substance combination, for a detergent (V2) having an otherwise identical composition, but containing only the ethoxylated polyethyleneimine, and for a detergent (V3) having an otherwise identical composition, but containing only 3 times the ethoxylated alcohol, and for chocolate milk/carbon black alone, and indicates the differences in reflectance values of C, V2, and V3 from the active substance-free agent V1, in each case as average values from six determinations.

TABLE 2

| Washing results | | | | |
|---|---|---|---|---|
| | C | V1 | V2 | V3 |
| 108 soils | 6822 | 6775 | 6795 | 6766 |
| Chocolate milk/carbon black | 2.1 | / | 1.1 | 0.4 |

The detergents containing an active substance combination to be used according to the invention showed much better primary washing power than the agents having an otherwise identical composition, but containing only one component of the combination, or containing no component of the combination.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A cleaning agent comprising a combination of from 0.3% by weight to 20% by weight polyalkoxylated polyamines which are obtainable by reacting polyamines having primary, secondary and tertiary amino groups, wherein the ratio of primary to secondary amino groups is 1:0.7 to 1:1, and wherein the ratio of primary to tertiary amino groups is 1:0.5 to 1:0.8, with alkylene oxide, and from 0.2% by weight to 10% by weight of a first nonionic surfactant selected from the group consisting of alkoxylated $C_8$-$C_{18}$ alcohols having an average alkoxylation number in the range of 1 to 5; and wherein the agent further comprises a surfactant system comprising:

a) from 0.1% by weight to 18% by weight synthetic anionic surfactants selected from the group consisting of alkyl sulfates, alkenyl sulfates, ether sulfates, α-sulfo esters, sulfosuccinates, and alkylbenzene sulfonates;

b) from 2% by weight to 25% by weight of second nonionic surfactant, different from said first nonionic surfactant, selected from the group of nonionic surfactants consisting of fatty alkyl polyglycosides, fatty alkyl polyalkoxylates, fatty acid polyhydroxyamides, ethoxylation and propoxylation products of fatty alkylamines, vicinal diols, fatty acid alkyl esters, and fatty acid amides.

2. The cleaning agent of claim 1 wherein the alkoxylated $C_8$-$C_{18}$ alcohol has an average alkoxylation number in the range of 2 to 4.

3. The cleaning agent of claim 1, characterized in that the N atoms in the polyamines are separated by alkylene groups containing 2 to 12 C atoms.

4. The cleaning agent of claim 1, characterized in that the polyamines have an average molar mass in the range of 500 g/mol. to 50,000 g/mol., and that the average number of alkoxy groups per primary and secondary amino function in the polyalkoxylated polyamines is 1 to 100.

5. The cleaning agent of claim 1, characterized in that the alcohols have 12 to 14 C atoms.

6. Method for removing soils, from textiles or hard surfaces, wherein a detergent or cleaning agent comprising a combination of from 0.3% by weight to 20% by weight polyalkoxylated polyamines which are obtainable by reacting polyamines having primary, secondary and tertiary amino groups, wherein the ratio of primary to secondary amino groups is 1:0.7 to 1:1, and wherein the ratio of primary to tertiary amino groups is 1:0.5 to 1:0.8, with alkylene oxide, and from 0.2% by weight to 10% by weight of first nonionic surfactant selected from the group consisting of alkoxylated $C_8$-$C_{18}$ alcohols having an average alkoxylation number in the range of 1 to 5; and wherein the agent further comprises a surfactant system comprising:

a) from 0.1% by weight to 18% by weight synthetic anionic surfactants selected from the group consisting of alkyl sulfates, alkenyl sulfates, ether sulfates, α-sulfo esters, sulfosuccinates, and alkylbenzene sulfonates;

b) from 2% by weight to 25% by weight of second nonionic surfactant, different from said first nonionic surfactant, selected from the group of nonionic surfactants consisting of fatty alkyl polyglycosides, fatty alkyl polyalkoxylates, fatty acid polyhydroxyamides, ethoxylation and propoxylation products of fatty alkylamines, vicinal diols, fatty acid alkyl esters, and fatty acid amides, is contacted with the soiled textiles or hard surfaces in a detergent or cleaning solution.

7. Method according to claim 6, characterized in that the concentration of the polyalkoxylated polyamines in the detergent or cleaning solution is 1 mg/L to 500 mg/L, and that the concentration of the alkoxylated $C_8$-$C_{18}$ alcohol having an average alkoxylation number in the range of 1 to 5 is 1 mg/L to 500 mg/L.

* * * * *